US009256993B2

(12) United States Patent
Urasawa et al.

(10) Patent No.: US 9,256,993 B2
(45) Date of Patent: Feb. 9, 2016

(54) ELECTRONIC CONTROL APPARATUS

(71) Applicant: DENSO CORPORATION, Kariya, Aichi-prf. (JP)

(72) Inventors: Shinpei Urasawa, Kariya (JP); Kazunori Okada, Chiryu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/164,367

(22) Filed: Jan. 27, 2014

(65) Prior Publication Data

US 2014/0324277 A1 Oct. 30, 2014

(30) Foreign Application Priority Data

Apr. 24, 2013 (JP) ..... 2013-091416

(51) Int. Cl.
*G07C 5/00* (2006.01)
*G07C 5/08* (2006.01)

(52) U.S. Cl.
CPC ..... *G07C 5/008* (2013.01); *G07C 5/085* (2013.01)

(58) Field of Classification Search
CPC ..... G07C 5/008; G07C 5/0808; G07C 5/085; G07C 2205/02; G07C 5/00; G07C 5/006; G07C 5/0816; G07C 5/0825; G07C 5/08; G07C 9/00126; G07C 9/00158
See application file for complete search history.

(56) References Cited

U.S. PATENT DOCUMENTS 8,321,086 B2 * 11/2012 Park et al. ..... 701/34.3
8,527,137 B2 * 9/2013 Sakakibara ..... 701/29.2
2003/0050747 A1 * 3/2003 Kamiya ..... 701/33
2003/0216889 A1 * 11/2003 Marko et al. ..... 702/182
2005/0096020 A1 * 5/2005 Oesterling et al. ..... 455/414.2
2006/0184295 A1 * 8/2006 Hawkins et al. ..... 701/33
2008/0255721 A1 * 10/2008 Yamada ..... 701/33
2009/0240392 A1 * 9/2009 Yamashita et al. ..... 701/33
2012/0271506 A1 10/2012 Hoshino et al.
2013/0246135 A1 * 9/2013 Wang ..... 705/14.4

FOREIGN PATENT DOCUMENTS

JP 09-032628 A 2/1997
JP 09-126954 A 5/1997
JP 2004-163187 A 6/2004

OTHER PUBLICATIONS

Office Action mailed Mar. 17, 2015 issued in corresponding JP patent application No. 2013-091416 (and English translation).
Office Action mailed Sep. 29, 2015 in the corresponding JP application No. 2013-091416 (with English translation).

* cited by examiner

*Primary Examiner* — Truc M Do
(74) *Attorney, Agent, or Firm* — Posz Law Group, PLC

(57) ABSTRACT

An electronic control apparatus includes a vehicle state storing processing part, which stores a vehicle state data when a predetermined trigger is generated, and a trigger setting processing part, which sets the trigger in correspondence to a designation from an external side. The electronic control apparatus further includes a data type setting part for setting, based on the designation from the external side, a stored vehicle state data type. The vehicle data storing part stores the vehicle state data in different addresses. The trigger setting part sets the trigger based on the address designated from the external side and a data length of the vehicle state data stored in the address. The data type setting part sets the stored vehicle state data type based on the address designated from the external side and the data length of the vehicle state data stored in the address.

9 Claims, 6 Drawing Sheets

FIG. 2A

| PID | SENSOR |
|---|---|
| 05 | COOLANT TEMPERATURE |
| 0C | ENGINE SPEED |
| 0D | VEHICLE SPEED |
| 0F | INTAKE TEMPERATURE |
| 10 | INTAKE QUANTITY |
| ⋮ | ⋮ |

FIG. 2B

| CONDITION NUMBER | CONDITION |
|---|---|
| 01 | = |
| 02 | < |
| 03 | ≤ |
| 04 | > |
| 05 | ≥ |
| ⋮ | ⋮ |

| DESIGNATION | 05 | 04 | 82 | 0C, 0D, 0F, 10 |
|---|---|---|---|---|
| SET TRIGGER | COOLANT TEMP | > | 90°C | ENGINE SPEED<br>VEHICLE SPEED<br>INTAKE TEMPERATURE<br>INTAKE QUANTITY |

FIG. 6

| BEFORE TRAVEL | DURING TRAVEL | AFTER STOP |
|---|---|---|
| SET | STORE | OUTPUT |

FIG. 7

| ADDRESS | DATA | |
|---|---|---|
| 00000000 | ・・・ | |
| ・<br>・<br>・ | ・<br>・<br>・ | |
| 00001000 | BATTERY CURRENT | LENGTH : 2 |
| 00001001 | | |
| 00001002 | BATTERY TEMPERATURE | LENGTH : 2 |
| 00001003 | | |
| ・<br>・<br>・ | ・<br>・<br>・ | |
| 10001100 | ・・・ | LENGTH : 1 |
| 10001101 | THROTTLE POSITION | LENGTH : 1 |
| ・<br>・<br>・ | ・<br>・<br>・ | |

| DESIGNATION | 00001002 | 02 | 04 | 50 | 00001000 | 02 |
|---|---|---|---|---|---|---|
| SET TRIGGER | BATTERY TEMPERATURE | | > | 80°C | BATTERY CURRENT | |

ELECTRONIC CONTROL APPARATUS

CROSS REFERENCE TO RELATED APPLICATION

This application is based on and incorporates herein by reference Japanese patent application No. 2013-91416 filed on Apr. 24, 2013.

FIELD

The present disclosure relates to an electronic control apparatus, which has a function of storing vehicle states.

BACKGROUND

It is conventional to store, when an abnormality is detected or an unintended behavior is detected for example, vehicle state data indicating vehicle states for retrieving data required for analyzing cause of failure of a vehicle. The vehicle state data is stored only when the abnormality arises or the unintended behavior arises. According to JP-A-H09-126954, a trigger generation device formed of a push button, for example, is provided so that vehicle state data may be stored in response to a trigger signal, which is generated when the trigger generation device is manually operated. The vehicle state data can be stored at an arbitrary time point that the trigger generation device is manually operated.

According to this technology, since the vehicle state data is stored in response to the manual operation on the trigger generation device, the time point of storing the vehicle state data sometimes becomes inappropriate. It is thus not possible in such a case to retrieve accurate vehicle state data required for later analysis.

SUMMARY

It is therefore an object to provide an electronic control apparatus, which enables appropriate setting of a time point of storing a vehicle state data indicating a vehicle operation state and retrieval of accurate vehicle state data required for analysis.

For achieving the object, an electronic control apparatus, which has a function of storing vehicle state data upon detection of abnormality in a vehicle, comprises a vehicle state storing part for storing vehicle state data when a predetermined trigger is generated, a trigger setting part for setting the trigger based on designation from an external side, and a data type setting part for setting based on the designation from the external side a stored vehicle state data type stored in the vehicle state storing part. The vehicle data storing part stores the vehicle state data in different addresses. The trigger setting part sets the trigger based on the address designated from the external side and a data length of the vehicle state data stored in the address. The data type setting part sets the stored vehicle state data type based on the address designated from the external side and the data length of the vehicle state data stored in the address.

BRIEF DESCRIPTION OF THE DRAWINGS

FIG. 2A and FIG. 2B are an illustration showing one example of a PID data list and an illustration showing one example of a condition number list;

FIG. 6 is an illustration showing schematically an entire operation from setting processing to outputting processing through storing processing;

FIG. 7 is an illustration showing one example of an address data list in a second embodiment;

EMBODIMENT

Figure 1:
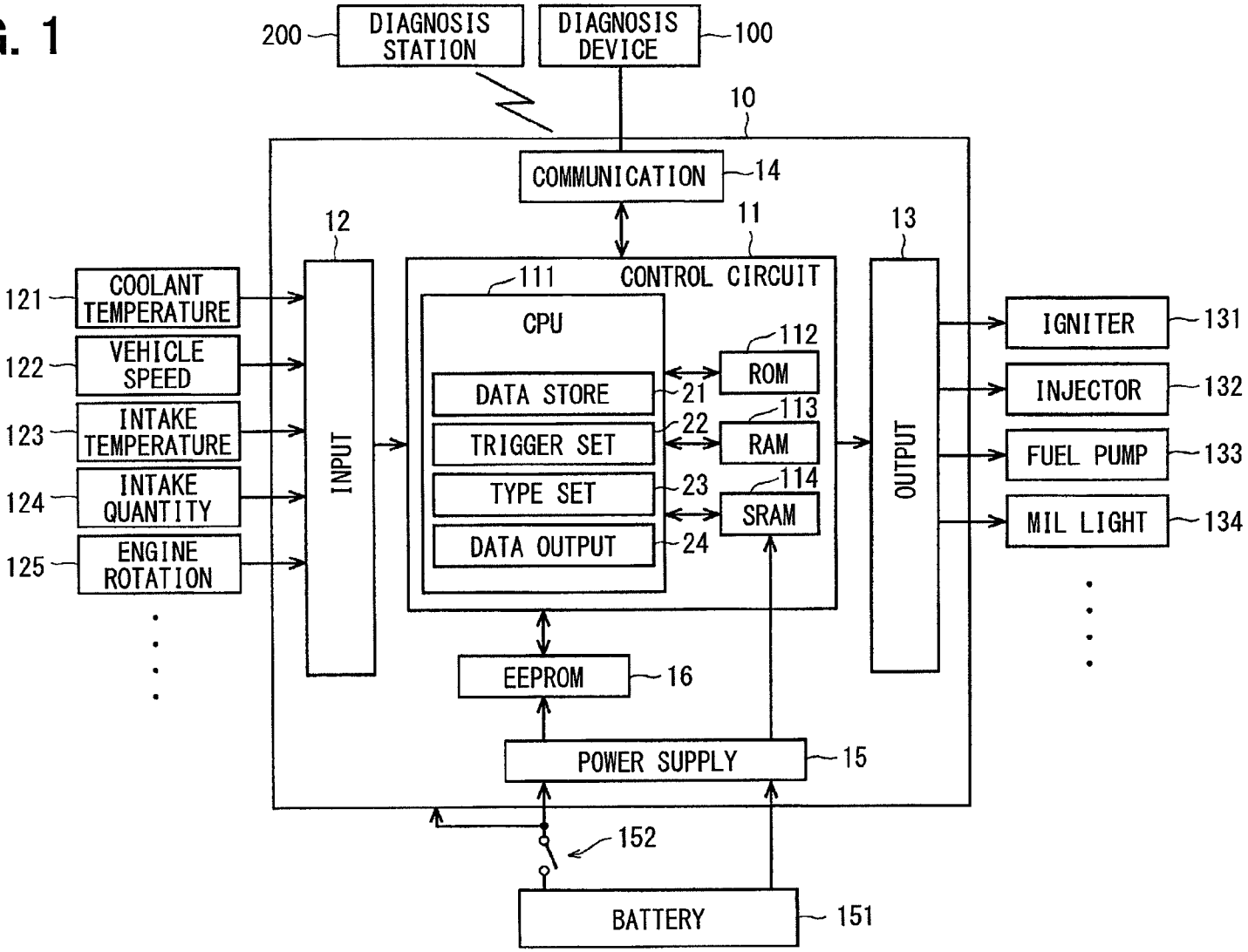
FIG. 1 is a block diagram showing schematically an electronic control apparatus according to a first embodiment.

An electronic control apparatus will be described with reference to plural embodiments shown in the drawings. Substantially same parts among the plural embodiments are designated with same reference numerals for brevity.

First Embodiment

Referring to FIG. 1, an electronic control apparatus is designated with a reference numeral 10. The electronic control apparatus 10 is mounted in a vehicle and includes a control circuit part 11, an input circuit part 12, an output circuit part 13, a communication circuit part 14, a power supply circuit part 15, an EEPROM 16 and the like. The control circuit part 11 is formed of a CPU 111 as a main circuit, a ROM 112, a RAM 113, a SRAM 114 and the like to control an entire operation of the electronic control apparatus 10. The control circuit part 11 functions as a vehicle state storing processing part 21, a trigger setting processing part 22, a data type setting processing part 23 and a data outputting processing part 24 by software with its CPU 111 executing control programs. These processing parts 21 to 24 may be realized by hardware as an integrated circuit incorporating the control circuit part 11 therein for example.

Plural sensors and the like for detecting vehicle operation states are connected to the input circuit part 12. The plural sensors include, for example, a coolant temperature sensor 121 for detecting a temperature of an engine coolant, a vehicle speed sensor 122 for detecting a vehicle travel speed, an intake air temperature sensor 123 for detecting a temperature of intake air of an engine, an intake air quantity sensor 124 for detecting a quantity of intake air of the engine and an engine rotation sensor 125 for detecting a rotation of the engine. These sensors are some examples of vehicle state detecting means. The input circuit part 12 outputs the detection data of those sensors to the control circuit part 11 as the vehicle state data indicating vehicle operation states. The vehicle state detecting means is not limited to those sensors but may include other detection means for detecting operation states of the vehicle. The other detection means includes, for example, a battery current detection sensor for detecting a current of a battery 151, a battery temperature sensor for detecting a temperature of a battery fluid and a throttle position sensor for detecting an open angle of a throttle of the engine.

The output circuit part 13 is connected to an igniter 131 for igniting the engine, injectors 132 for injecting fuel into the engine, a fuel pump 133 for pressure-feeding the fuel, an MIL light 134 for lighting upon detection of abnormality in the engine system. The output circuit part 13 drives those output systems in response to commands from the control circuit part 11. The electronic control apparatus 10 has an abnormality detecting function, which is a conventional function of detecting abnormality in the vehicle based on the vehicle state data retrieved from the input circuit part 12 or the vehicle state data outputted to the output circuit part 13. The electronic control apparatus 10 also has a function of storing the vehicle state data, which is present when the abnormality of the vehicle is detected by the abnormality detecting function. The electronic control apparatus 10 further has, as described in detail below, a function of storing the vehicle state data, which is detected when a set trigger is generated.

The electronic control apparatus 10 communicates with an external diagnosis device 100 through the communication circuit part 14. The external diagnosis device 100 is provided externally to the vehicle. In this case, the external diagnosis device 100 is connected to the electronic control apparatus 10 via a wired communication network. The electronic control apparatus 10 further has a remote diagnosing function, which is a function of communication with an external diagnosis station 200 located at a remote location through a radio communication network via the communication circuit part 14. The external diagnosis device 100 or the external diagnosis station 200 collects the vehicle state data from the electronic control apparatus 10 mounted in each vehicle. The power supply circuit 15 is connected to an in-vehicle battery 151 to supply electric power of the in-vehicle battery 151 to the electronic control apparatus 10. The power supply circuit 15 continuously supplies the electric power of the in-vehicle battery 151 to the SRAM 114, which is a volatile memory. The power supply circuit 15 supplies the electric power of the in-vehicle battery 151 to the EEPROM 16, which is a nonvolatile memory, on condition that an ignition switch 152 is in the on-state.

The vehicle state storing processing part 21 is one example of a vehicle state storing part, which stores the vehicle state data outputted from the input circuit part 12 in the SRAM 114 or the EEPROM 16, each time a preset predetermined trigger is generated. Since the SRAM 114 is continuously powered, the vehicle state data stored in the SRAM 114 are maintained even when the engine is stopped. Since the EEPROM 16 is the nonvolatile memory, the vehicle state data stored in the EEPROM 16 are maintained even when the power supply from the battery 151 is shut down.

The trigger setting processing part 22 is one example of a trigger setting part, which sets the trigger in response to a command from the external diagnosis device 100 or the external diagnosis station 200 for storing the vehicle state data. That is, this trigger causes the vehicle state storing processing part 21 to store the vehicle state data. The data type setting processing part 23 is one example of a data type setting part, which sets a stored vehicle state data type stored by the vehicle state storing processing part 21 in response to the command from the external diagnosis device 100 or the external diagnosis station 200. The data outputting processing part 24 is one example of a data outputting part, which outputs to the external diagnosis device 100 or the external diagnosis station 200 the vehicle state data stored by the vehicle state storing processing part 21.

One example of method of setting a trigger and one example of setting a stored vehicle state data type, that is, a type of vehicle state data to be stored in the electronic control apparatus 10, will be described next. That is, the electronic control apparatus 10 has a PID data list (PID: parameter identification) shown in, for example, FIG. 2A. As shown in this list, a different PID is set as an identification number for each sensor, which detects a vehicle operation state, and each actuator. The electronic control apparatus 10 further has a condition number data list shown in, for example, FIG. 2B. As shown in this list, a different condition number is set for each required condition, which forms a factor required for trigger generation. An analyzer, who is an external operator of the external diagnosis device 100 or the external diagnosis station 200, analyzes a cause of failure of a vehicle, for example, makes an input manipulation on the external diagnosis device 100 or the external diagnosis station 200 thereby to designate a vehicle state forming a factor of a trigger generation, a required condition, a threshold value and a stored vehicle state data type. The external diagnosis device 100 or the external diagnosis station 200 designates the vehicle state forming the factor required for trigger generation, the required condition, the threshold value and the stored vehicle state data type to the electronic control apparatus 100 in response to the input manipulation.

Figures 3, 4:
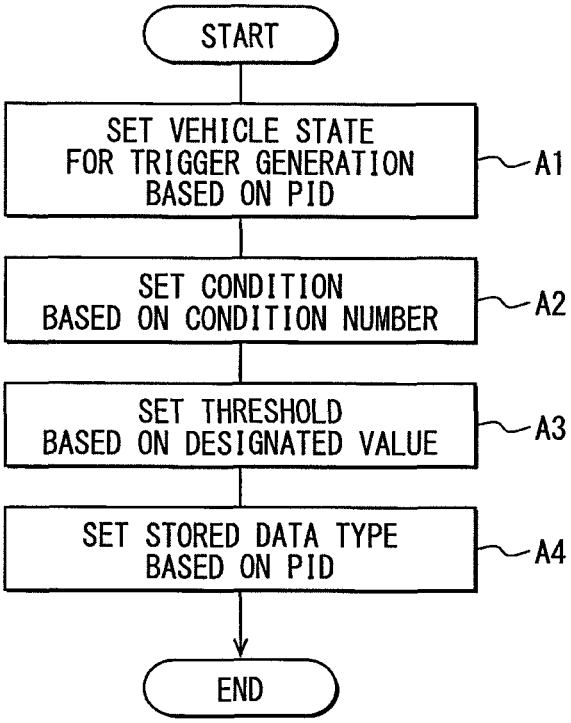
FIG. 3 is a flowchart showing one example of an operation of the electronic control apparatus according to the first embodiment.
FIG. 4 is an illustration showing one example of a relation between a designated content and a trigger, which is set by the designated content.

More specifically, as shown in FIG. 3 for example, the electronic control apparatus 10 sets the vehicle state forming the factor required for trigger generation, the required condition, the threshold value and the stored vehicle state data type in response to the designation from the external diagnosis device 100 or the external diagnosis station 200. That is, the electronic control apparatus 10 sets at step A1 the vehicle state forming the factor of trigger generation in response to the PID designated by the external diagnosis device 100 or the external diagnosis station 200. Then the electronic control apparatus 10 sets at step A2 the condition based on the condition number designated by the external diagnosis device 100 or the external diagnosis station 200. The electronic control apparatus 10 sets at step A3 the threshold value based on a value designated by the external diagnosis device 100 or the external diagnosis station 200. The electronic control apparatus 10 sets at step A4 the stored vehicle state data type based on the PID designated by the external diagnosis device 100 or the external diagnosis station 200.

Figure 5:
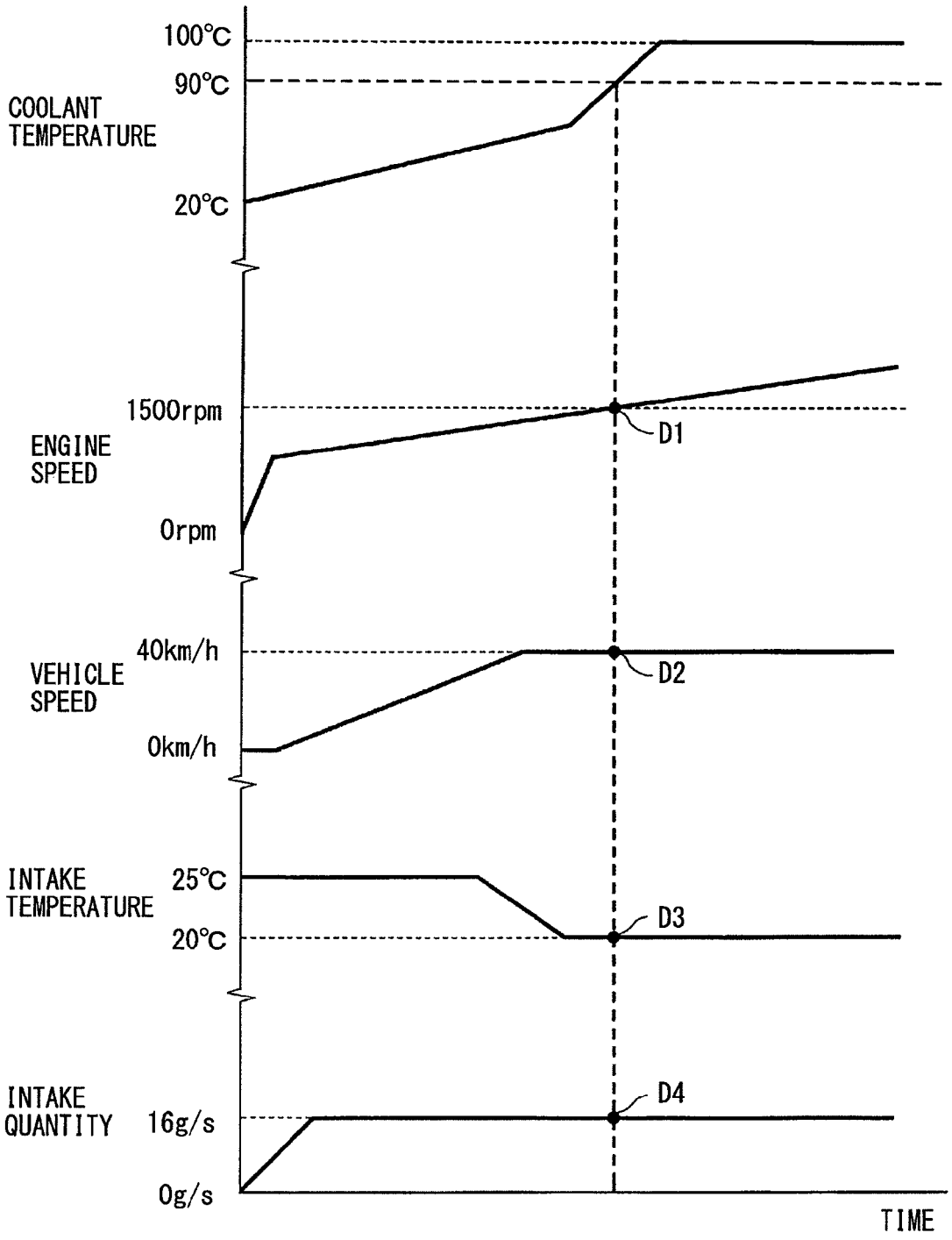
FIG. 5 is a time chart showing one example of the vehicle state data, which are stored when a set trigger is generated.

It is assumed here that, as shown in FIG. 4, the PID designated at step A1 is "05", the condition number designated at step A2 is "04," the value designated at step A3 is "82". In this case, "coolant temperature>90° C." which indicates that the coolant temperature detected by the coolant temperature sensor 121 has become higher than 90° C. is set as the trigger. In a case that the PIDs designated at step A4 are "0C," "0D," "0F" and "10", the engine rotation speed, the vehicle speed, the intake air temperature and the intake air quantity are set as the stored vehicle state data type. In the case of this example of setting, as shown in FIG. 5 for example, the electronic control apparatus 10 stores the engine rotation speed D1, the vehicle speed D2, the intake air temperature D3 and the intake air quantity D4, which are detected at a time point, when the coolant temperature detected by the coolant temperature sensor 121 exceeds the threshold value, that is, 90° C.

In the case of this example of setting, the external operator inputs "05 04 82 0C 0D 0F 10" to the external diagnosis device 100 or the external diagnosis station 200. In the specification of the coolant temperature data, the offset value is set to "40." In the specification of the coolant temperature data, LSB, which is the lowest significant bit, is set to "1". As a result, when the coolant temperature data changes by "1," it means that the temperature indicated by the coolant temperature data changes 1° C. If the threshold value is desired to be set to 90° C., the offset value itself is added to this temperature value to result in 130° C. This resultant sum is set as "82" by conversion to hexadecimal number.

As shown in FIG. 6, the processing of setting the trigger and the stored vehicle state data type designated by the external diagnosis device 100 or the external diagnosis station 200 is executed before the vehicle starts traveling. During vehicle traveling, the electronic control apparatus 10 stores the vehicle state data, which are detected at the time point when the set trigger is generated. After the vehicle stops, the external diagnosis device 100 or the external diagnosis station 200 issues a data output request to the electronic control apparatus 10 in response to the operation by the external operator, for example. The electronic control apparatus 10 outputs the stored vehicle state data in response to the data output request from the external diagnosis device 100 or the external diagnosis station 200.

As described above, according to the first embodiment, the electronic control apparatus 10 stores the vehicle state data detected at a time point when the preset trigger is generated. This trigger is set based on the designation from the external diagnosis device 100 or the external diagnosis station 200. Thus the trigger for storing the vehicle state data can be set simply by designation from the external diagnosis device 100 or the external diagnosis station 200. Since the timing for storing the vehicle state data can be set to the appropriate timing arbitrarily, the accurate vehicle state data required for analysis can be retrieved surely.

The electronic control apparatus 100 further sets the type of the stored vehicle state data based on the designation by the external diagnosis device 100 or the external diagnosis station 200. The type of stored data can be designated simply by the external diagnosis device 100 or the external diagnosis station 200. It is thus possible to retrieve only the vehicle state data required for analysis. In setting the trigger and the stored vehicle state data type, the external operator is only required to designate from the external side, for example. It is not necessary to change the control program itself, which is provided in the electronic control apparatus 10.

The electronic control apparatus 10 sets the trigger and the type of stored vehicle state data based on the PID designated by the external diagnosis device 100 or the external diagnosis station 200. That is, since the PID, which is set for each sensor for detecting a vehicle state, is used in common among all vehicles, such identification information can be utilized effectively. In the case that the electronic control apparatus 10 is designated from the external side by the external diagnosis station 200 through the radio communication network, the external operator is allowed to set from the remote location, for example, without moving to the vehicle mounting the electronic control apparatus 10 thereon. In the case that the electronic control apparatus 10 outputs the stored vehicle state data to the external diagnosis station 200 through the radio communication network, the external operator can analyze the cause of failure at the remote location.

Second Embodiment

The second embodiment is different from the first embodiment in methods of setting the trigger and setting the type of stored vehicle state data. Only this difference will be described below. That is, the electronic control apparatus 10 has an address data list as shown in, for example, FIG. 7. As shown by the list, each vehicle state data is set to be stored in different address of a memory device provided in the electronic control apparatus 10. The data length of each vehicle state data is different in correspondence to the type of data. For example, a data of current (current data) of the battery 151, which is detected by a battery current detection sensor (not shown), is set to be stored in addresses "00001000" to "00001001" and its data length is 2. In a case that the data length is 2, such a vehicle state data is stored over two successive addresses. A data of a throttle open angle (throttle position data) detected by a throttle position sensor (not shown) is set to be stored in an address "10001101" and its data length is 1. In a case that the data length is 1, such a vehicle state data is stored in one address. The operator makes an input manipulation on the external diagnosis device 100 for designating the vehicle state forming the factor required for trigger generation, for example. In response to this input manipulation, the external diagnosis device 100 designates the vehicle state forming the trigger and the like to the electronic control apparatus 10.

Figures 8, 9:
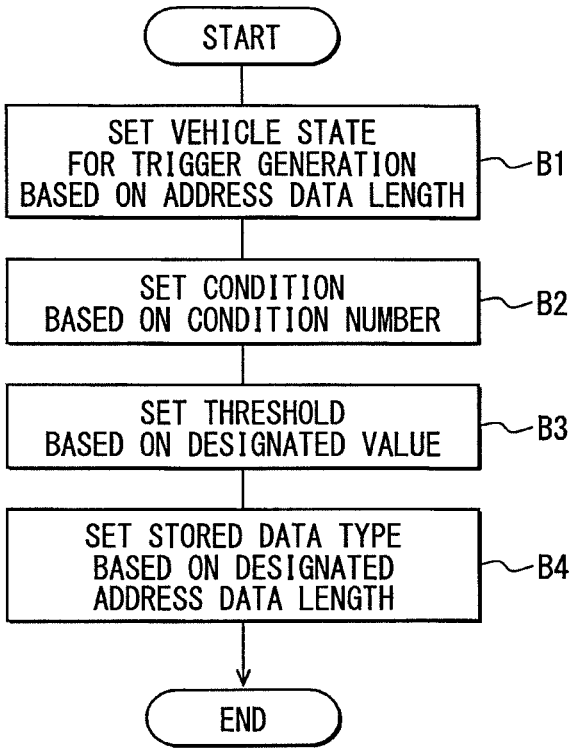
FIG. 8 is a flowchart showing one example of an operation of the electronic control apparatus according to the second embodiment.
FIG. 9 is an illustration showing one example of a relation between a designated content and a trigger, which is set by the designated content.

More specifically, as shown in FIG. 8, for example, the electronic control apparatus 10 sets the vehicle state forming the factor for trigger generation based on the designation by the external diagnosis device 100 or the external diagnosis station 200. That is, the electronic control apparatus 10 sets at step B1 the vehicle state forming the factor required for trigger generation based on the address designated by the external diagnosis device 100 or the external diagnosis station 200 and the data length. The electronic control apparatus 10 then sets at step B2 the condition based on the condition number designated by the external diagnosis device 100 or the external diagnosis station 200. The electronic control apparatus 10 sets at step B3 the threshold value, which may correspond to abnormality in a vehicle, based on a value designated by the external diagnosis device 100 or the external diagnosis station 200. The electronic control apparatus 10 sets at step B4 the type of stored vehicle state data based on the address designated by the external diagnosis device 100 or the external diagnosis station 200 and the data length.

It is assumed here that, as shown in FIG. 9, the address designated at step B1 is "00001002" and the data length is "02" indicating 2, the condition number designated at step B2 is "04", and the value designated at step B3 is 50. In this case, "battery temperature>80° C." which indicates that the temperature of the battery fluid detected by the battery fluid temperature sensor has become higher than 80° C. is set as the trigger. In a case that the address designated at step B4 is "00001000" and the data length is "02" indicating 2, the battery current is set as the stored vehicle state data type. In this case of example of setting, the operator inputs "00001002 02 04 50 00001000 02" to the external diagnosis device 100 or the external diagnosis station 200.

As described above, according to the second embodiment, the trigger and the type of stored vehicle state data are set based on the address designated by the external diagnosis device 100 or the external diagnosis station 200 as well as the data length. As a result, the trigger and the like can be set by effectively using the address in the memory area, which is pre-allocated for each vehicle state data and the data length of each vehicle state data.

Other Embodiments

The electronic control apparatus described above should not be limited to the above-described embodiments but may be implemented in various embodiments. For example, the PID, the address, the condition number and the like may be designated in binary number or decimal number in place of hexadecimal number.

What is claimed is:

1. An electronic control apparatus, which has a function of storing vehicle state data upon detection of abnormality in a vehicle, the electronic control apparatus comprising:

a vehicle state storing part for storing vehicle state data when a predetermined trigger is generated;

a trigger setting part for setting the trigger based on designation from an external side; and a data type setting part for setting, based on the designation from the external side, a stored vehicle state data type stored in the vehicle state storing part, wherein the vehicle state storing part stores the vehicle state data in different addresses, the trigger setting part sets the trigger based on the address designated from the external side and a data length of the vehicle state data stored in the address, and the data type setting part sets the stored vehicle state data type based on the address designated from the external side and the data length of the vehicle state data stored in the address.

2. The electronic control apparatus according to claim 1, further comprising:

a communication part for receiving the designation from the external side via radio communication.

3. The electronic control apparatus according to claim 1, further comprising:

a data outputting part for outputting externally the vehicle state data stored in the vehicle state storing part.

4. The electronic control apparatus according to claim 3, wherein:

the data outputting part outputs externally the vehicle state data via radio communication.

5. The electronic control apparatus according to claim 1, wherein the external side, designation from which the trigger is set by the setting part, is outside the vehicle.

6. The electronic control apparatus according to claim 1, wherein the electronic control apparatus is adapted to mount in the vehicle, to connect to sensors in the vehicle, and to receive, from the sensors in the vehicle, detection data of the sensors as the vehicle state data.

7. The electronic control apparatus according to claim 1, wherein the external side, designation from which the trigger is set by the setting part, is outside the vehicle, and the electronic control apparatus is adapted to mount in the vehicle, to connect to sensors in the vehicle, and to receive, from the sensors in the vehicle, detection data of the sensors as the vehicle state data.

8. The electronic control apparatus according to claim 1, wherein the electronic control apparatus is adapted to mount in the vehicle, the electronic control apparatus is adapted to connect to vehicle output systems in the vehicle and to drive the vehicle output systems.

9. The electronic control apparatus according to claim 7, wherein the electronic control apparatus further is adapted to connect to vehicle output systems in the vehicle and to drive the vehicle output systems.

* * * * *